US011976656B2

(12) United States Patent
Yoshida et al.

(10) Patent No.: US 11,976,656 B2
(45) Date of Patent: May 7, 2024

(54) ROOTS PUMP CONTAINING ROTORS THAT CAPTURE AND DISCHARGE A FOREIGN SUBSTANCE

(71) Applicant: KABUSHIKI KAISHA TOYOTA JIDOSHOKKI, Aichi (JP)

(72) Inventors: Masaya Yoshida, Aichi (JP); Daisuke Masaki, Aichi (JP); Ryosuke Fukuyama, Aichi (JP); Katsutoshi Shiromaru, Aichi (JP)

(73) Assignee: KABUSHIKI KAISHA TOYOTA JIDOSHOKKI, Aichi (JP)

( * ) Notice: Subject to any disclaimer, the term of this patent is extended or adjusted under 35 U.S.C. 154(b) by 0 days.

(21) Appl. No.: 18/121,625

(22) Filed: Mar. 15, 2023

(65) Prior Publication Data

US 2023/0304497 A1 Sep. 28, 2023

(30) Foreign Application Priority Data

Mar. 23, 2022 (JP) ..... 2022-046925

(51) Int. Cl.
*F04C 18/12* (2006.01)
*F01C 19/00* (2006.01)
(Continued)

(52) U.S. Cl.
CPC ..... *F04C 18/126* (2013.01); *F01C 19/005* (2013.01); *F04C 18/14* (2013.01);
(Continued)

(58) Field of Classification Search
CPC ..... F04C 18/126; F04C 18/14; F04C 27/002; F04C 27/004; F04C 2210/1055;
(Continued)

(56) References Cited

U.S. PATENT DOCUMENTS 5,336,069 A 8/1994 Matsuyama
7,287,970 B2 * 10/2007 Hirano ..... F04C 18/126 418/140

FOREIGN PATENT DOCUMENTS

JP H06-264879 A 9/1994
JP 2006183541 A * 7/2006
WO WO-2013167605 A2 * 11/2013 ..... F04C 18/084

OTHER PUBLICATIONS

English Machine translation of JP2006-183541A (via USPTO Fit database on Dec. 7, 2023 (Year: 2006).*

* cited by examiner

*Primary Examiner* — Dominick L Plakkoottam
*Assistant Examiner* — Paul W Thiede
(74) *Attorney, Agent, or Firm* — Greenblum & Bernstein, P.L.C.

(57) ABSTRACT

A roots pump includes a housing, a rotor chamber, a pair of rotary shafts, and a pair of rotors. The rotor chamber includes a rotor chamber peripheral surface facing a pair of distal end portions of each of the rotors. Each of the pair of the distal end portions includes: a pair of rotor peripheral surfaces facing the rotor chamber peripheral surface with a first radial clearance; and a distal end peripheral surface that is formed between the pair of the rotor peripheral surfaces in the rotational direction and faces the rotor chamber peripheral surface with a second radial clearance greater than the first radial clearance. A width of the rotor chamber peripheral surface facing the distal end peripheral surface in the rotational direction is greater than a sum of a pair of predetermined widths of the rotor chamber peripheral surface facing the pair of the rotor peripheral surfaces.

6 Claims, 5 Drawing Sheets

(51) Int. Cl.
*F04C 18/14* (2006.01)
*F04C 27/00* (2006.01)

(52) U.S. Cl.
CPC ..... *F04C 27/002* (2013.01); *F04C 27/004* (2013.01); *F04C 2210/1055* (2013.01); *F04C 2230/602* (2013.01); *F04C 2230/91* (2013.01); *F04C 2230/92* (2013.01); *F04C 2240/20* (2013.01); *F04C 2240/30* (2013.01); *F04C 2240/40* (2013.01); *F04C 2250/20* (2013.01)

(58) Field of Classification Search
CPC ..... F04C 2230/602; F04C 2230/91; F04C 2230/92; F04C 2240/20; F04C 2240/30; F04C 2240/40; F04C 2250/20; F01C 19/005
See application file for complete search history.

ROOTS PUMP CONTAINING ROTORS THAT CAPTURE AND DISCHARGE A FOREIGN SUBSTANCE

CROSS-REFERENCE TO RELATED APPLICATION

This application claims priority to Japanese Patent Application No. 2022-046925 filed on Mar. 23, 2022, the entire disclosure of which is incorporated herein by reference.

BACKGROUND ART

The present disclosure relates to a roots pump.

Japanese Patent Application Publication No. H06-264879 discloses an air pump serving as a roots pump, for example. In the air pump, a pair of rotors is disposed in a columnar space serving as a rotor chamber. An inner peripheral surface of the columnar space forms a housing inner peripheral surface serving as a rotor chamber peripheral surface. An outer peripheral surface of a distal end portion of each of the rotors forms a large arc surface. The large arc surface has a radius of curvature equivalent to that of the housing inner peripheral surface.

In such a roots pump, a space between the housing inner peripheral surface and the distal end portion of each of the rotors is sealed with a predetermined radial clearance. A value of the radial clearance is set such that leakage of fluid from its high-pressure side toward its low-pressure side through the radial clearance is prevented.

A foreign substance may enter the rotor chamber of the roots pump. When the foreign substance is larger than the radial clearance, the foreign substance is bitten between the housing inner peripheral surface and the distal end portion of each of the rotors. When the rotor rotates with the foreign substance being bitten between the housing inner peripheral surface and the distal end portion of each of the rotors, the foreign substance damages the distal end portion of each of the rotors and the housing inner peripheral surface. To suppress such a damage, the radial clearance may be larger than the foreign substance. However, when the radial clearance is larger than the foreign substance, a leakage amount of fluid from its high-pressure side toward its low-pressure side through the radial clearance increases, which undesirably degrades performance of the pump.

SUMMARY

In accordance with an aspect of the present disclosure, there is provided a roots pump that includes: a housing; a rotor chamber that is defined in the housing and includes a suction hole from which fluid is drawn and a discharge hole from which the fluid is discharged; a pair of rotary shafts rotatably supported in the housing; and a pair of rotors having a cocoon shape, the pair of rotors that is attached to the pair of the rotary shafts, respectively, and rotates in the rotor chamber. The rotor chamber includes a rotor chamber peripheral surface that is formed of a pair of arc surfaces connecting the suction hole and the discharge hole in a radial direction of each of the rotors and that faces a pair of distal end portions of each of the rotors with a predetermined radial clearance. In the rotor chamber, in response to rotation of the pair of rotors, the fluid drawn from the suction hole is guided to the pair of the arc surfaces of the rotor chamber peripheral surface and is discharged from the discharge hole. Each of the pair of the distal end portions of each of the rotors includes: a pair of rotor peripheral surfaces that faces the rotor chamber peripheral surface with a first radial clearance, the rotor chamber peripheral surface having a pair of predetermined widths in a rotational direction of each of the rotors; and a distal end peripheral surface that is formed between the pair of the rotor peripheral surfaces in the rotational direction, faces the rotor chamber peripheral surface with a second radial clearance greater than the first radial clearance, and captures a foreign substance in the rotor chamber at a time of rotation of the pair of the rotors. A width of the rotor chamber peripheral surface facing the distal end peripheral surface in the rotational direction is greater than a sum of the pair of the predetermined widths of the rotor chamber peripheral surface facing the pair of the rotor peripheral surfaces.

Other aspects and advantages of the disclosure will become apparent from the following description, taken in conjunction with the accompanying drawings, illustrating by way of example the principles of the disclosure.

BRIEF DESCRIPTION OF THE DRAWINGS

The disclosure, together with objects and advantages thereof, may best be understood by reference to the following description of the embodiments together with the accompanying drawings in which.

DETAILED DESCRIPTION OF THE EMBODIMENTS

First Embodiment

Hereinafter, a roots pump according to a first embodiment will be described with reference to FIG. 1 to FIG. 5.

Overall Configuration of Roots Pump

The roots pump serving as a hydrogen pump is mounted on a fuel cell vehicle. A fuel cell system supplying oxygen and hydrogen to generate electric power is mounted on the fuel cell vehicle. The roots pump supplies hydrogen gas discharged from the fuel cell to a fuel cell again. Thus, in the roots pump, the hydrogen gas serving as fluid is drawn and discharged.

Housing

Figure 1:
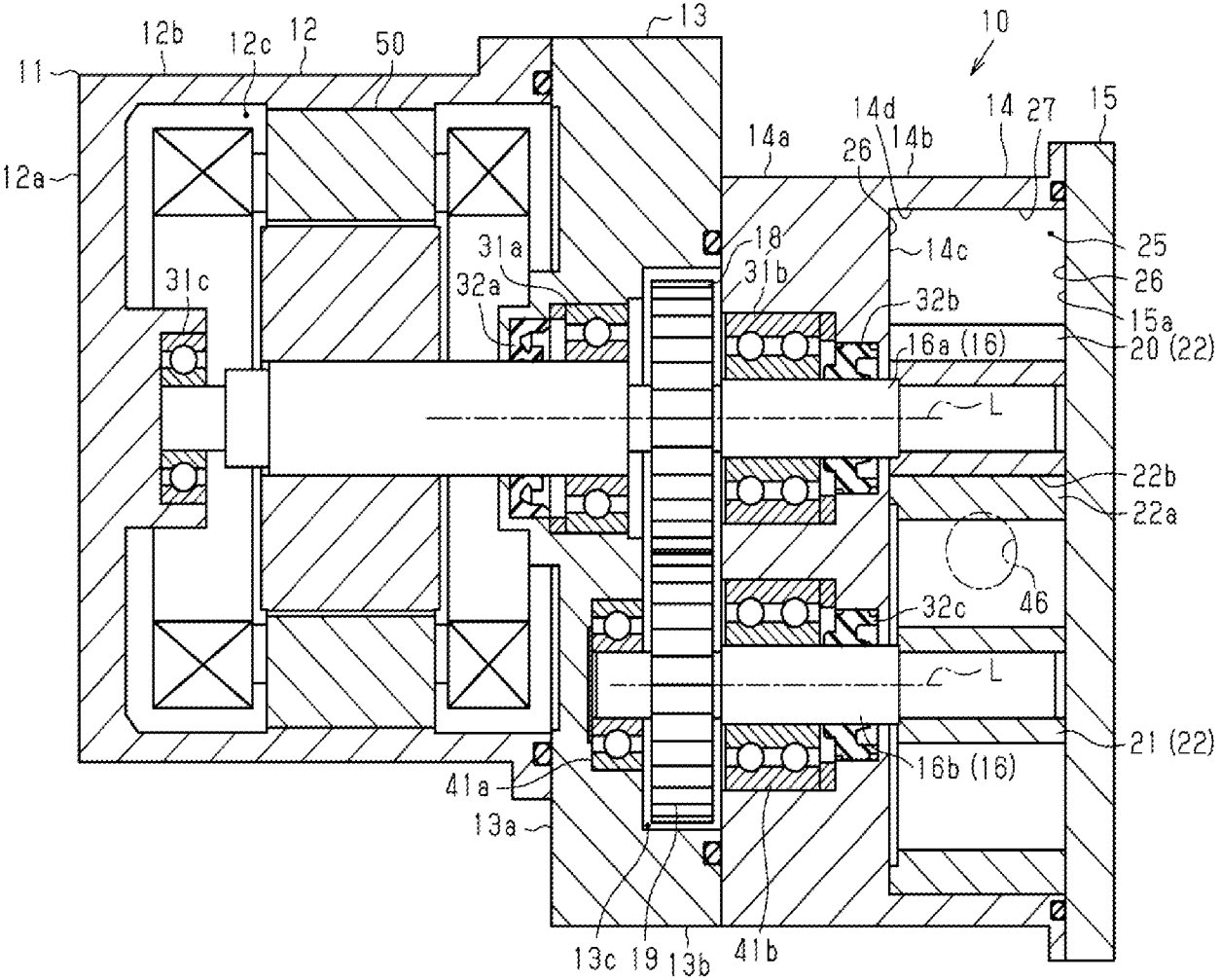
FIG. 1 is a cross-sectional view of a roots pump according to a first embodiment.

As illustrated in FIG. 1, the roots pump 10 includes a housing 11 having a tubular shape. The housing 11 includes a motor housing 12, a gear housing 13, a rotor housing 14, and a cover member 15.

The motor housing 12 is connected to the gear housing 13. The rotor housing 14 is connected to the gear housing 13. The cover member 15 is connected to the rotor housing 14.

The motor housing 12 has a bottom wall 12*a* having a plate shape, and a peripheral wall 12*b* tubularly extending from an outer peripheral portion of the bottom wall 12*a*. The gear housing 13 has a bottom wall 13*a* having a plate shape, and a peripheral wall 13*b* tubularly extending from an outer peripheral portion of the bottom wall 13*a*. The rotor housing 14 has a bottom wall 14*a* having a plate shape, and a peripheral wall 14*b* tubularly extending from an outer peripheral portion of the bottom wall 14*a*.

The bottom wall 13*a* of the gear housing 13 is coupled to the peripheral wall 12*b* of the motor housing 12. The bottom wall 14*a* of the rotor housing 14 is coupled to the peripheral wall 13*b* of the gear housing 13. The cover member 15 has a plate shape. The cover member 15 is coupled to the peripheral wall 14*b* of the rotor housing 14.

A gear chamber 13*c* is defined in the housing 11. The gear chamber 13*c* is defined by the bottom wall 13*a* of the gear housing 13, the peripheral wall 13*b* of the gear housing 13, and the bottom wall 14*a* of the rotor housing 14.

Rotor Chamber

The roots pump 10 includes a rotor chamber 25 defined in the housing 11. The rotor chamber 25 is defined by the bottom wall 14*a* of the rotor housing 14, the peripheral wall 14*b* of the rotor housing 14, and the cover member 15.

The housing 11 has a pair of rotor chamber end surfaces 26 and a rotor chamber peripheral surface 27. One of the pair of the rotor chamber end surfaces 26 is formed of an inner wall surface 14*c* of the bottom wall 14*a* of the rotor housing 14. The other of the pair of the rotor chamber end surfaces 26 is formed of an inner wall surface 15*a* of the cover member 15. The rotor chamber end surfaces 26 are positioned on opposite ends of the rotor chamber 25. The rotor chamber peripheral surface 27 is formed of an inner peripheral surface 14*d* of the peripheral wall 14*b*. The rotor chamber peripheral surface 27 is formed of a pair of arc surfaces 27*a*.

Rotary Shaft

The roots pump 10 includes a drive shaft 16*a* and a driven shaft 16*b* which serve as a rotary shaft 16. Hereinafter, the drive shaft 16*a* and the driven shaft 16*b* are collectively referred to as a pair of rotary shafts 16. The drive shaft 16*a* is disposed parallel to the driven shaft 16*b*. A direction in which a shaft center L of each of the rotary shafts 16 extends is referred to as an axial direction. The drive shaft 16*a* extends through the bottom wall 13*a* of the gear housing 13 and the bottom wall 14*a* of the rotor housing 14. The driven shaft 16*b* extends through the bottom wall 14*a* of the rotor housing 14.

A first drive bearing 31*a* is disposed at the bottom wall 13*a* of the gear housing 13. A second drive bearing 31*b* is disposed at the bottom wall 14*a* of the rotor housing 14. A third drive bearing 31*c* is disposed at the bottom wall 12*a* of the motor housing 12. The drive shaft 16*a* is rotatably supported in the housing 11 by the first drive bearing 31*a*, the second drive bearing 31*b*, and the third drive bearing 31*c*.

A first driven bearing 41*a* is disposed at the bottom wall 13*a* of the gear housing 13. A second driven bearing 41*b* is disposed at the bottom wall 14*a* of the rotor housing 14. The driven shaft 16*b* is rotatably supported in the housing 11 by the first driven bearing 41*a* and the second driven bearing 41*b*. Thus, the pair of the rotary shafts 16 is rotatably supported in the housing 11.

A first seal member 32*a* is provided at the bottom wall 13*a* of the gear housing 13. The first seal member 32*a* seals a gap between the drive shaft 16*a* and the bottom wall 13*a* of the gear housing 13. A second seal member 32*b* is provided at the bottom wall 14*a* of the rotor housing 14. The second seal member 32*b* seals a gap between the drive shaft 16*a* and the bottom wall 14*a*. A third seal member 32*c* is provided at the bottom wall 14*a* of the rotor housing 14. The third seal member 32*c* seals a gap between the driven shaft 16*b* and the bottom wall 14*a*.

Electric Motor

The roots pump 10 includes an electric motor 50 that causes the drive shaft 16*a* to rotate. The electric motor 50 is accommodated in a motor chamber 12*c* defined in the housing 11. The motor chamber 12*c* is defined by the bottom wall 12*a* of the motor housing 12, the peripheral wall 12*b* of the motor housing 12, and the bottom wall 13*a* of the gear housing 13. The electric motor 50 causes the drive shaft 16*a* to rotate.

The roots pump 10 includes a drive gear 18 that has a disk shape and is fixed to the drive shaft 16*a*, and a driven gear 19 that has a disk shape and is fixed to the driven shaft 16*b*. The drive gear 18 and the driven gear 19 are accommodated in the gear chamber 13*c*. The driven gear 19 rotates while meshing with the drive gear 18. The driven gear 19 rotates together with the drive gear 18 in a direction opposite to a rotational direction of the drive shaft 16*a*.

Suction Hole and Discharge Hole

The rotor chamber 25 includes a suction hole 45 from which hydrogen gas is drawn into the rotor chamber 25, and a discharge hole 46 from which the hydrogen gas in the rotor chamber 25 is discharged. The suction hole 45 and the discharge hole 46 are formed in the peripheral wall 14*b* of the rotor housing 14. The suction hole 45 and the discharge hole 46 face each other on opposite sides of the rotor chamber 25. The rotor chamber 25 communicates with an outside of the rotor chamber 25 through the suction hole 45 and the discharge hole 46. The suction hole 45 is connected to the discharge hole 46 through the pair of the arc surfaces 27*a* of the rotor chamber peripheral surface 27.

Drive Rotor and Driven Rotor

Figure 2:
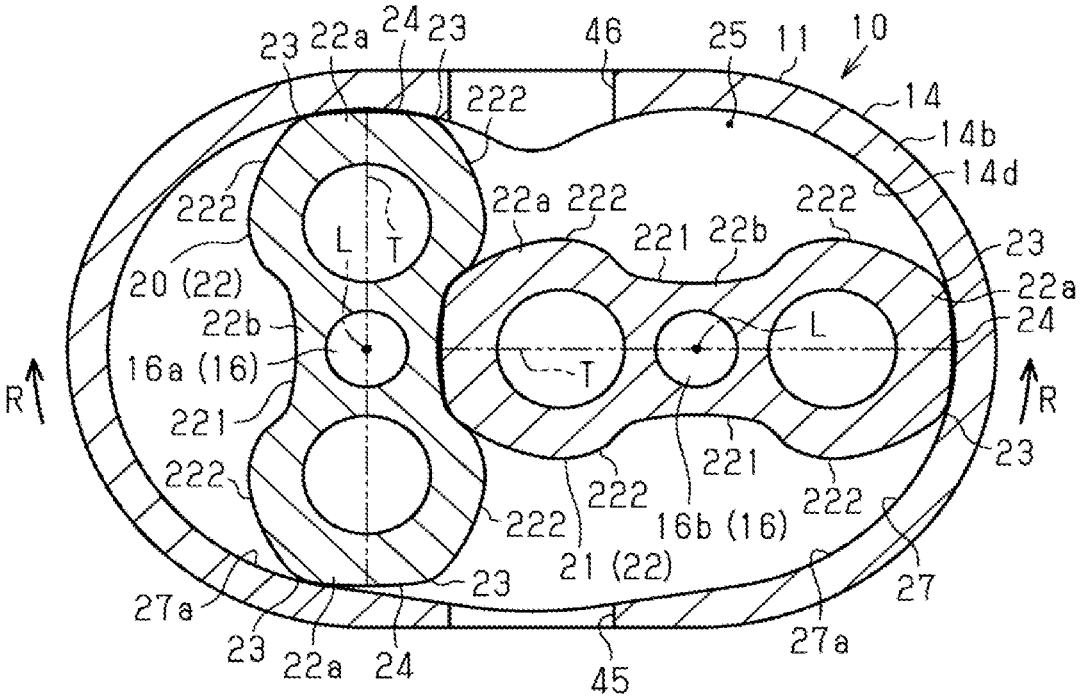
FIG. 2 is a cross-sectional view of the roots pump according to the first embodiment.

As illustrated in FIG. 1 and FIG. 2, the roots pump 10 includes a drive rotor 20 and a driven rotor 21 which serve as a pair of rotors 22 having a two-lobed cocoon shape. Hereinafter, the drive rotor 20 and the driven rotor 21 are collectively referred to as the pair of rotors 22. In the roots pump 10, when the pair of the rotors 22 rotates, the hydrogen gas drawn from the suction hole 45 is guided to the pair of the arc surfaces 27*a* of the rotor chamber 25. The hydrogen gas guided to the arc surfaces 27*a* is discharged from the discharge hole 46 to an outside of the roots pump 10. In the roots pump 10, as a leakage amount of fluid from its high-pressure side toward its low-pressure side through a radial clearance between the rotor 22 and the rotor chamber peripheral surface 27 decreases, performance of a pump increases.

The drive rotor 20 rotates in response to an action of the drive gear 18. The driven rotor 21 rotates in response to an action of the driven gear 19. The pair of the rotors 22 is accommodated in the rotor chamber 25. The drive rotor 20 is attached to the drive shaft 16*a*. The driven rotor 21 is attached to the driven shaft 16*b*. The driven rotor 21 rotates together with the drive rotor 20. Thus, the drive rotor 20 and the driven rotor 21 form a pair and correspond to the pair of the rotors 22 having a cocoon shape and rotates in a direction opposite to each other in the rotor chamber 25.

The pair of the rotor chamber end surfaces 26 faces each other on opposite sides of the pair of the rotors 22 in an axial direction of each of the rotary shafts 16. The rotor chamber peripheral surface 27 surrounds a radially outer periphery of each of the rotors 22. A radial direction of the drive rotor 20 coincides with that of the drive shaft 16*a*. A radial direction of the driven rotor 21 coincides with that of the driven shaft 16*b*.

The rotors 22 each include a pair of distal end portions 22*a* and a constricted portion 22*b* formed between the pair of distal end portions 22*a*. A line connecting the distal end portions 22*a* of each of the rotors 22 through the shaft center L of each of the rotary shafts 16 is referred to as a straight line "T".

Each of the distal end portions 22*a* includes a pair of rotor peripheral surfaces 23, a distal end peripheral surface 24 positioned between the pair of the rotor peripheral surfaces 23, and curved surfaces 222 being continuous with the rotor peripheral surfaces 23. Each of the rotor peripheral surfaces 23 and the distal end peripheral surface 24 is formed of an arc surface. The curved surfaces 222 are each curved based on an involute of a curve.

Figure 3:
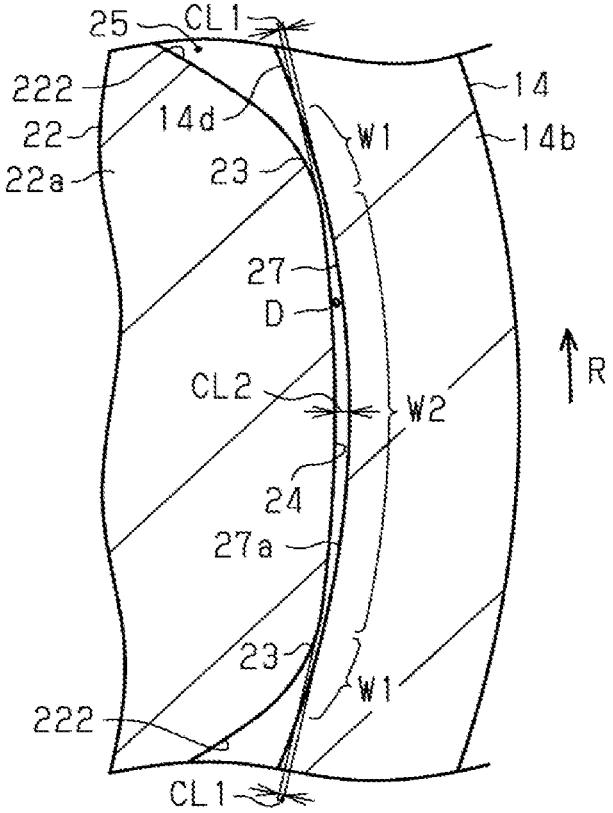
FIG. 3 is an enlarged cross-sectional view of a rotor peripheral surface and a distal end peripheral surface.

As illustrated in FIG. 3, each of the rotor peripheral surfaces 23 faces the rotor chamber peripheral surface 27 with a first radial clearance CL1. Thus, the rotor chamber peripheral surface 27 faces each of the distal end portions 22*a* of the rotors 22 in a radial direction of each of the rotors 22 with the first radial clearance CL1 within a predetermined range. The pair of the rotor peripheral surfaces 23 each have a predetermined width in a rotational direction R of each of the rotors 22. A width of the rotor chamber peripheral surface 27 facing each of the rotor peripheral surfaces 23 is referred to as a width "W1". Each of the rotor peripheral surfaces 23 is formed of the arc surface with an arc radius r1 whose central point is the shaft center L.

The arc surfaces 27*a* of the rotor chamber peripheral surface 27 each have an arc radius r2 whose central point is the shaft center L. The arc radius r1 of each of the rotor peripheral surfaces 23 is slightly smaller than the arc radius r2 of each of the arc surfaces 27*a*. The first radial clearance CL1 is formed between each of the rotor peripheral surfaces 23 and the corresponding arc surface 27*a*. The first radial clearance CL1 is set within the predetermined range such that leakage of hydrogen gas from its high-pressure side toward its low-pressure side through the first radial clearance CL1 is suppressed.

The distal end peripheral surface 24 is formed between the pair of the rotor peripheral surfaces 23 in the rotational direction R. A width of the rotor chamber peripheral surface 27 facing the distal end peripheral surface 24 in the rotational direction R is referred to as a width "W2". The width W2 is greater than a sum of pair of widths W1 of the rotor chamber peripheral surface 27 facing the pair of the rotor peripheral surfaces 23 (the width W1 of the rotor chamber peripheral surface 27 facing one of the rotor peripheral surfaces 23 and the width W1 of the rotor chamber peripheral surface 27 facing the other of the rotor peripheral surfaces 23).

Thus, the following inequation holds.

$$W2>W1+W1 \qquad \text{Inequation}$$

Therefore, a dimension of the distal end peripheral surface 24 in the rotational direction R is greater than that of each of the rotor peripheral surfaces 23 in the rotational direction R.

The distal end peripheral surface 24 faces the rotor chamber peripheral surface 27 with a second radial clearance CL2 greater than the first radial clearance CL1. The distal end peripheral surface 24 is formed of the arc surface with an arc radius r3 whose central point is the shaft center L. The arc radius r3 of the arc surface forming the distal end peripheral surface 24 is greater than the arc radius r1 of the arc surface forming each of the rotor peripheral surfaces 23, and greater than the arc radius r2 of each of the arc surfaces 27*a* forming the rotor chamber peripheral surface 27. Thus, the second radial clearance CL2 gradually increases in the rotational direction R from one of the rotor peripheral surfaces 23 toward the other of the rotor peripheral surfaces 23. The second radial clearance CL2 is maximized at an intermediate position between the pair of the rotor peripheral surfaces 23 in the rotational direction R. The second radial clearance CL2 is gradually reduced in the rotational direction R from the intermediate position between the pair of the rotor peripheral surfaces 23 toward the other of the rotor peripheral surfaces 23.

As described above, the roots pump 10 supplies hydrogen gas discharged from the fuel cell, to the fuel cell again. At this time, a foreign substance D in the hydrogen gas discharged from the fuel cell may enter the rotor chamber 25. The foreign substance D may be also generated due to a contact between the rotors 22 or the like in the rotor chamber 25. The first radial clearance CL1 is smaller than a maximum dimension of the foreign substance D.

The second radial clearance CL2 is greater than the maximum dimension of the foreign substance D. The second radial clearance CL2 is greater than the first radial clearance CL1. Specifically, a maximum value of the second radial clearance CL2 is approximately five times greater than that of the first radial clearance CL1. The distal end peripheral surface 24 defining the second radial clearance CL2 catches the foreign substance D in the rotor chamber 25 at a time of rotation of the rotors 22.

As illustrated in FIG. 2, the constricted portion 22*b* corresponds to a part of each of the rotors 22 to which each of the rotary shafts 16 is fixed. The constricted portion 22*b* is formed in a constricted shape between the pair of the distal end portions 22*a*. The constricted portion 22*b* has a pair of constricted peripheral surfaces 221. The constricted peripheral surfaces 221 are disposed on opposite sides of each of the rotary shafts 16 in its radial direction.

Figure 5:
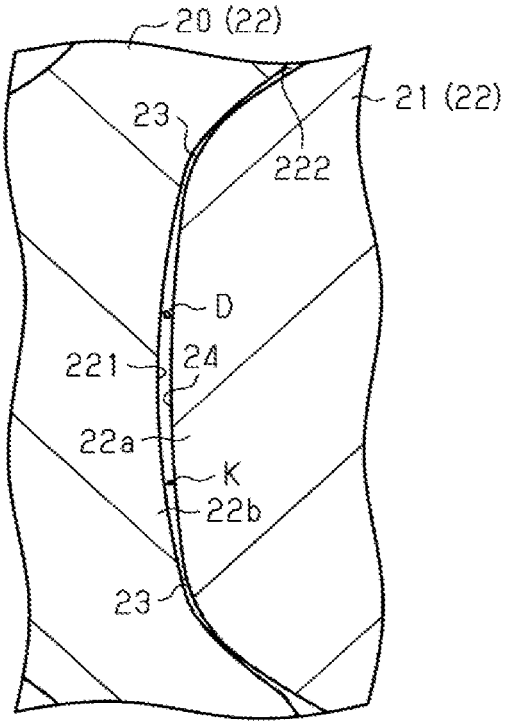
FIG. 5 is an enlarged cross-sectional view of a constricted portion and the distal end peripheral surface.

As illustrated in FIG. 5, each of the constricted peripheral surfaces 221 forms an arc surface with an arc radius r4. The arc radius r4 of each of the constricted peripheral surfaces 221 is smaller than the arc radius r3 of the distal end peripheral surface 24. Thus, when the pair of rotor peripheral surface 23 and the distal end peripheral surface 24 face a corresponding one of the constricted peripheral surfaces 221, a gap K is formed between the distal end peripheral surface 24 and the corresponding one of the constricted peripheral surfaces 221.

The gap K gradually increases from one of the rotor peripheral surfaces 23 toward the other of the rotor peripheral surfaces 23. A dimension of the gap K in the radial direction of each of the rotors 22 is maximized at an intermediate position between the pair of the rotor peripheral surfaces 23 in the rotational direction R. The dimension of the gap K in the radial direction of each of the rotors 22 is greater than the maximum dimension of the foreign substance D. The gap K is gradually reduced from the intermediate position between the pair of the rotor peripheral surfaces 23 toward the other of the rotor peripheral surfaces 23.

In the roots pump 10, hydrogen gas drawn from the suction hole 45 is confined by the distal end portions 22*a* of the rotors 22. The hydrogen gas is pumped toward the discharge hole 46 while being confined. The confined hydrogen gas is discharged from the discharge hole 46. An area from a position in which the hydrogen gas drawn from the suction hole 45 is confined to a position in which the hydrogen gas is discharged from the discharge hole 46 is referred to as a "pumping area." In the pumping area, the hydrogen gas drawn from the suction hole 45 is confined by the distal end portions 22*a* of the rotors 22 and pumped toward the discharge hole 46. The pumping area is an area from a position in which the rotors 22 start confining the hydrogen gas to a position in which the rotors 22 finish confining the hydrogen gas.

Operation of Embodiment

Next, an operation of the embodiment will be described.

The drive shaft 16*a* rotates in response to a drive of the electric motor 50. Then, the driven shaft 16*b* rotates in a direction opposite to a rotational direction of the drive shaft 16*a* through the drive gear 18 and the driven gear 19 which mesh with each other. As a result, the pair of the rotors 22 each rotates in a direction opposite to each other. In the roots pump 10, hydrogen gas is drawn from the suction hole 45 into the rotor chamber 25, and discharged from the rotor chamber 25 through the discharge hole 46 by the rotation of the pair of the rotors 22.

The hydrogen gas drawn from the suction hole 45 is confined by the distal end portions 22*a* of the rotors 22 and pumped toward the discharge hole 46. In the roots pump 10, when the rotors 22 are located at the position in which the rotors 22 finish confining the hydrogen gas, one of the distal end portions 22*a* of each of the rotors 22 is closest to the discharge hole 46. At this time, internal compression of the hydrogen gas occurs in a space confined by the pair of the rotors 22. The space confined by the pair of the rotors 22 is sealed by the distal end portions 22*a* of the rotors 22, specifically, by the rotor peripheral surfaces 23 and the distal end peripheral surface 24.

The first radial clearance CL1 is formed between each of the rotor peripheral surfaces 23 and the rotor chamber peripheral surface 27. The second radial clearance CL2 greater than the first radial clearance CL1 is formed between the distal end peripheral surface 24 and the rotor chamber peripheral surface 27. Thus, the first radial clearance CL1 and the second radial clearance CL2 cause a labyrinth effect, which prevents leakage of hydrogen gas from its high-pressure side toward its low-pressure side.

Figure 4:
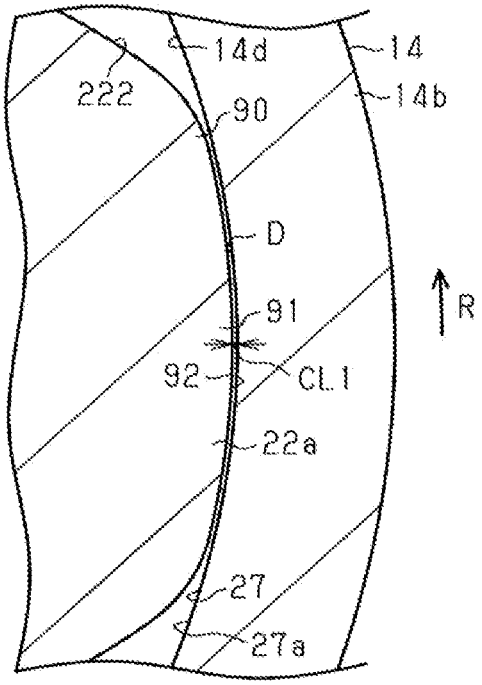
FIG. 4 is an enlarged cross-sectional view of a rotor according to a comparison example.

FIG. 4 illustrates a rotor 90 according to a comparison example. A distal end portion 91 of the rotor 90 has an arc peripheral surface 92. The arc peripheral surface 92 forms an arc surface with the same arc radius r1 as that of each of the rotor peripheral surfaces 23 of the above-described embodiment. Thus, the arc peripheral surface 92 faces the rotor chamber peripheral surface 27 with the first radial clearance CL1. In the comparison example, a distal end portion 91 of the rotor 90 faces the rotor chamber peripheral surface 27 with the first radial clearance CL1 across an entire length of the arc peripheral surface 92 along the rotational direction R.

In a roots pump including the rotor 90 of the comparison example, the first radial clearance CL1 is smaller than the maximum dimension of the foreign substance D. Thus, when the foreign substance D is present in the rotor chamber 25, the foreign substance D enters a space between each of the rotor peripheral surfaces 23 and the rotor chamber peripheral surface 27. After that, while the rotor 90 rotates in the rotational direction R, the foreign matter D remains to exist between the arc peripheral surface 92 and the rotor chamber peripheral surface 27. That is, the foreign substance D remains to be bitten between the arc peripheral surface 92 and the rotor chamber peripheral surface 27.

On the other hand, in the present embodiment, the foreign substance D firstly enters a space between one of the rotor peripheral surfaces 23 preceding the other of the rotor peripheral surfaces 23 in the rotational direction R and the rotor chamber peripheral surface 27. After that, in response to rotation of the rotors 22 in the rotational direction R, the foreign substance D moves from the one of the rotor peripheral surfaces 23 toward the distal end peripheral surface 24 following the one of the rotor peripheral surfaces 23 in the rotational direction R.

As described above, a relationship "W2>W1+W1" holds. The second radial clearance CL2 is greater than the first radial clearance CL1. Thus, at a time of rotation of the rotors 22, even when the foreign substance D enters between the one of the rotor peripheral surfaces 23 preceding the other of the rotor peripheral surfaces 23 in the rotational direction R and the rotor chamber peripheral surface 27 facing the one of the rotor chamber peripheral surfaces 23, the foreign substance D moves toward a space between the distal end peripheral surface 24 and the rotor chamber peripheral surface 27 by the rotation of the rotors 22.

The second radial clearance CL2 is greater than the maximum dimension of the foreign substance D. As a result, the foreign substance D is not bitten between the distal end peripheral surface 24 and the rotor chamber peripheral surface 27 while the foreign substance D is positioned between the distal end peripheral surface 24 and the rotor chamber peripheral surface 27.

After that, even when the rotors 22 rotate, the foreign substance D is positioned between the distal end peripheral surface 24 and the rotor chamber peripheral surface 27, which prevents the foreign substance D from entering a space between the other of the rotor peripheral surfaces 23 following the one of the rotor peripheral surfaces 23 in the rotational direction R and the rotor chamber peripheral surface 27 facing the other of the rotor peripheral surfaces 23. That is, the foreign substance D remains to be captured between the distal end peripheral surface 24 and the rotor chamber peripheral surface 27 facing the distal end peripheral surface 24.

The foreign substance D moves toward the discharge hole 46 in response to rotation of the rotors 22. After that, the distal end peripheral surface 24 faces the discharge hole 46, and then, the foreign substance D is discharged from the discharge hole 46 to the outside of the rotor chamber 25.

As illustrated in FIG. 5, in response to rotation of the rotors 22, the distal end portion 22*a* sometimes faces the constricted portion 22*b*. At this time, the gap K is defined between the distal end peripheral surface 24 and the constricted peripheral surface 221. Even when the foreign substance D enters a space between the pair of the rotors 22, the foreign substance D moves to the gap K.

Effects of First Embodiment

According to the above-described embodiment, the following effects are obtained.

(1-1) The pair of the rotor peripheral surfaces 23 and the distal end peripheral surface 24 are provided at each of the distal end portions 22*a* of each of the rotors 22. The second radial clearance CL2 is greater than the first radial clearance CL1 in the radial direction and the rotational direction R of each of the rotors 22. Thus, at a time of rotation of the rotors 22, even when the foreign substance D enters a space between the one of the rotor peripheral surfaces 23 preceding the other of the rotor peripheral surfaces 23 and the rotor chamber peripheral surface 27 facing the one of the rotor peripheral surface 23, the foreign substance D is captured between the distal end peripheral surface 24 and the rotor chamber peripheral surface 27 in response to rotation of the rotors 22. After that, even when the rotors 22 rotate, the foreign substance D is positioned between the distal end peripheral surface 24 and the rotor chamber peripheral surface 27, which prevents the foreign substance D from entering a space between the other of the rotor peripheral surfaces 23 following the one of the rotor peripheral surfaces 23 in the rotational direction R and the rotor chamber peripheral surface 27 facing the other of the rotor peripheral surfaces 23. This prevents the foreign substance D from remaining to be bitten between each of the distal end portions 22*a* of each of the rotors 22 and the rotor chamber peripheral surface 27. As a result, damages of the distal end portions 22*a* and the rotor chamber peripheral surface 27 due to the foreign substance D being bitten between each of the distal end portions 22*a* of each of the rotors 22 and the rotor chamber peripheral surface 27 may be prevented, and occurrence of a foreign substance may be prevented.

Although the distal end peripheral surface 24 is provided at the distal end portions 22*a* of the rotors 22 to capture the foreign substance D, the rotor peripheral surfaces 23 are also provided at the distal end portions 22*a* of the rotors 22. Thus, the first radial clearance CL1 smaller than the second radial clearance CL2 formed by the distal end peripheral surface 24 is provided at each of the distal end portions 22*a*.

Then, a dimensional relationship between the first radial clearance CL1 and the second radial clearance CL2 causes a labyrinth effect, which ensures sealing performance of the rotors 22 at the distal end portions 22*a*. Thus, even when the distal end peripheral surface 24 is provided at the distal end portions 22*a*, a leakage amount of hydrogen gas from its high-pressure side toward its low-pressure side through the clearances between the distal end portions 22*a* and the rotor chamber peripheral surface 27. Thus, deterioration of performance of a pump is prevented while reducing the damages due to the foreign substance D being bitten between each of the distal end portions 22*a* and the rotor chamber peripheral surface 27.

(1-2) The arc radius r3 of the arc surface forming the distal end peripheral surface 24 is greater than the arc radius r1 of the arc surface forming each of the rotor peripheral surfaces 23 and is greater than the arc radius r2 of the arc surface 27*a* forming the rotor chamber peripheral surface 27. Thus, each of the rotors 22 with the second radial clearance CL2 greater than the first radial clearance CL1 is easily manufactured.

(1-3) The arc radius r4 of each of the constricted peripheral surfaces 221 of the constricted portion 22*b* is smaller than the arc radius r3 of the arc surface forming the distal end peripheral surface 24. Thus, when each of the distal end portion 22*a* faces the constricted portion 22*b*, the gap K is defined between the distal end peripheral surface 24 and the corresponding constricted peripheral surface 221. Then, the foreign substance D entering a space between the pair of rotors 22 moves to the gap K.

Second Embodiment

Next, a roots pump 10 according to a second embodiment will be described with reference to FIG. 6. In the second embodiment, since shapes of the distal end portions 22*a* of the rotors 22 described in the first embodiment are each changed, detailed description of similar portions will be omitted.

Figure 6:
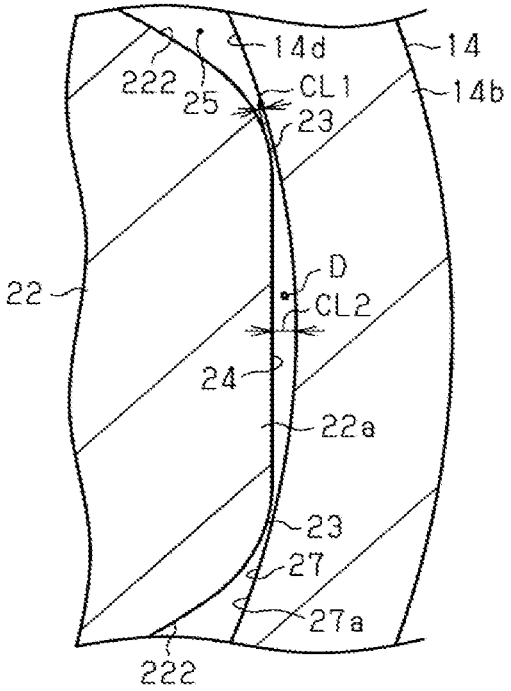
FIG. 6 is an enlarged cross-sectional view of a rotor of a roots pump according to a second embodiment.

As illustrated in FIG. 6, at the distal end portion 22*a* of each of the rotors 22, the distal end peripheral surface 24 is formed between the rotor peripheral surfaces 23 to form a flat surface. In addition, the distal end peripheral surface 24 connects the pair of the rotor peripheral surfaces 23 in a straight manner to form the flat surface. Although the first radial clearance CL1 is the same as in the first embodiment, the second radial clearance CL2 is greater than that of the first embodiment.

Effect of Second Embodiment

According to the second embodiment, the following effect is obtained, in addition to the effect (1-1) of the first embodiment.

(2-1) Since the distal end peripheral surface 24 is the flat surface, the distal end peripheral surface 24 is easily formed in each of the rotors 22.

Third Embodiment

Next, a roots pump 10 according to a third embodiment will be described with reference to FIG. 7. In the third embodiment, since shapes of the distal end portions 22*a* of the rotors 22 described in the first embodiment are each changed, detailed description of similar portions will be omitted.

Figure 7:
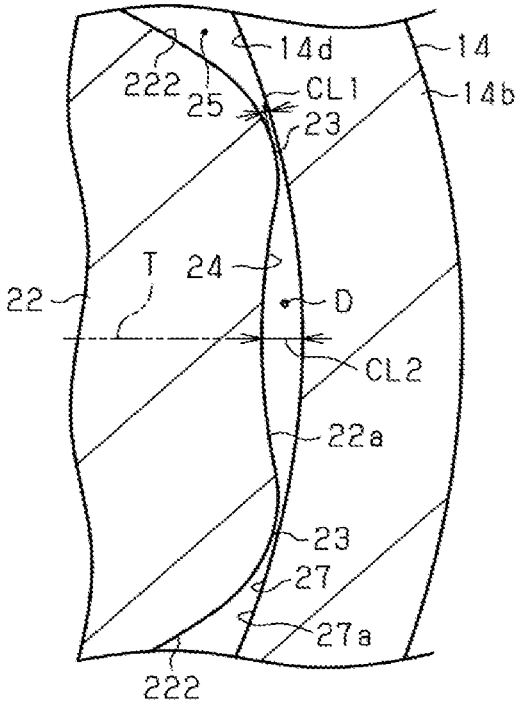
FIG. 7 is an enlarged cross-sectional view of a rotor of a roots pump according to a third embodiment.

As illustrated in FIG. 7, the distal end peripheral surface 24 is a curved surface recessed in an arc shape from the distal end portion 22*a* of each of the rotors 22 toward the shaft center L of each of the rotary shafts 16 along the straight line T. The distal end peripheral surface 24 connects the pair of the rotor peripheral surfaces 23 in the arc shape. Although the first radial clearance CL1 is the same as in the first embodiment, the second radial clearance CL2 is greater than that of the first embodiment.

Effect of Third Embodiment

According to the third embodiment, the following effect is obtained, in addition to the effect (1-1) of the first embodiment.

(3-1) Since the distal end peripheral surface 24 is an arc surface which is recessed toward the shaft center L, a width of the second radial clearance CL2 increases. As a result, the foreign substance D is easily captured on the distal end peripheral surface 24.

The embodiments may be changed and implemented as follows. The embodiments may be combined with the following modified embodiment within a technically consistent range.

Figure 8:
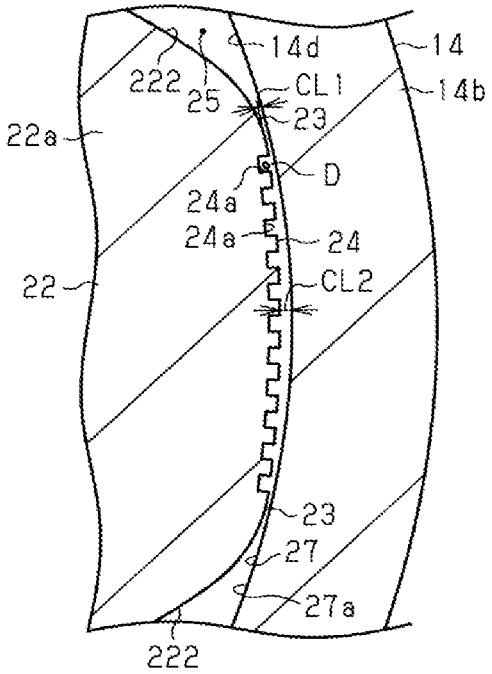
FIG. 8 is an enlarged cross-sectional view of a rotor of a roots pump according to a modified embodiment.

In each of the embodiments, as illustrated in FIG. 8, a groove 24*a* in which the distal end peripheral surface 24 is recessed toward the rotary shafts 16 may be formed at the distal end portions 22*a* of each of the rotors 22.

In each of the rotors 22 of the first embodiment, a plurality of grooves 24*a* is preferably formed on the distal end peripheral surface 24. The grooves 24*a* are formed on the entire distal end peripheral surface 24 in the axial direction of each of the rotary shafts 16. A width of each of the grooves 24*a* opened in the rotation direction R and a depth of each of the grooves 24*a* in the radial direction of each of the rotors 22 are preferably set such that the entire foreign matter D is stored. However, even when the foreign substance D having entered the grooves 24*a* is projected from the distal end peripheral surface 24, the depth of each of the grooves 24*a* may be appropriately changed as long as the foreign substance D does not come into contact with the rotor chamber peripheral surface 27 taking advantage of the size of the second radial clearance CL2.

The grooves 24*a* may be formed on the distal end peripheral surface 24 of the second embodiment, or may be formed on the distal end peripheral surface 24 of the third embodiment. The grooves 24*a* may be formed on the rotor chamber peripheral surface 27.

At the constricted portion 22*b* of each of the rotors 22, the arc radius r4 of each of the constricted peripheral surfaces 221 may be the same as or greater than the arc radius r3 of the distal end peripheral surface 24.

Each of the rotors 22 may have a tri-lobed shape or a four-lobed shape as seen in a cross-sectional view of each of the rotors 22 in a direction orthogonal to the axial direction of each of the rotary shafts 16.

A drive source of the roots pump 10 may be an engine, for example. In this case, the drive shaft 16*a* extends through the bottom wall 13*a* of the gear housing 13 so that the drive shaft 16*a* is connected to the engine as the drive source provided outside the gear chamber 13*c*.

The roots pump 10 need not be a fuel cell hydrogen pump supplying hydrogen gas to the fuel cell, but may be any pump used for other purposes. That is, fluid drawn into the rotor chamber 25 may be any fluid other than hydrogen gas.

What is claimed is:

1. A roots pump comprising:

a housing;

a rotor chamber that is defined in the housing and includes a suction hole from which fluid is drawn and a discharge hole from which the fluid is discharged;

a pair of rotary shafts rotatably supported in the housing; and a pair of rotors, the pair of rotors that is attached to the pair of the rotary shafts, respectively, and rotates in the rotor chamber, the rotor chamber including a rotor chamber peripheral surface that is formed of a pair of arc surfaces connecting the suction hole and the discharge hole in a radial direction of each of the rotors and that faces a pair of distal end portions of each of the rotors with a predetermined radial clearance comprising a first radial clearance and a second radial clearance, in response to rotation of the pair of rotors, in the rotor chamber, fluid drawn from the suction hole being guided to the pair of the arc surfaces of the rotor chamber peripheral surface and being discharged from the discharge hole, wherein each of the pair of the distal end portions of each of the rotors includes:

a pair of rotor peripheral surfaces that faces the rotor chamber peripheral surface with the first radial clearance, the pair of the rotor peripheral surfaces facing the rotor chamber peripheral surface having a pair of predetermined widths in a rotational direction of each of the rotors; and a distal end peripheral surface that is formed between the pair of the rotor peripheral surfaces in the rotational direction, faces the rotor chamber peripheral surface with the second radial clearance greater than the first radial clearance, and captures a foreign substance in the rotor chamber at a time of rotation of the pair of the rotors, and a width of the rotor chamber peripheral surface facing the distal end peripheral surface in the rotational direction is greater than a sum of the pair of the predetermined widths of the rotor chamber peripheral surface facing the pair of the rotor peripheral surfaces.

2. The roots pump according to claim 1, wherein each of the rotor peripheral surfaces and the distal end peripheral surface is formed of an arc surface, and an arc radius of the arc surface forming the distal end peripheral surface is greater than an arc radius of the arc surface forming each of the rotor peripheral surfaces and is greater than an arc radius of each of the pair of the arc surfaces forming the rotor chamber peripheral surface.

3. The roots pump according to claim 1, wherein the distal end peripheral surface is formed between the pair of the rotor peripheral surfaces to form a flat surface.

4. The roots pump according to claim 1, wherein the distal end peripheral surface is a curved surface recessed in an arc shape from each of the pair of the distal end portions of each of the rotors toward a shaft center of each of the rotary shafts along a straight line connecting the pair of the distal end portions of each of the rotors through a central point of each of the rotary shafts.

5. The roots pump according to claim 2, wherein each of the rotors includes a constricted portion that is provided between the pair of the distal end portions, and to which each of the rotary shafts is fixed, and the constricted portion has a constricted peripheral surface formed of an arc surface with an arc radius smaller than the arc radius of the arc surface forming the distal end peripheral surface.

6. The roots pump according to claim 1, wherein a groove recessed from the distal end peripheral surface toward the rotary shafts is provided at each of the pair of the distal end portions of each of the rotors, and the groove extends in an axial direction of each of the rotary shafts.

* * * * *